US010376021B2

(12) United States Patent
Hsu

(10) Patent No.: US 10,376,021 B2
(45) Date of Patent: Aug. 13, 2019

(54) BUCKLE ASSEMBLY

(71) Applicant: Frank Hsu, Chino, CA (US)

(72) Inventor: Frank Hsu, Chino, CA (US)

( * ) Notice: Subject to any disclaimer, the term of this patent is extended or adjusted under 35 U.S.C. 154(b) by 172 days.

(21) Appl. No.: 15/507,703

(22) PCT Filed: Jul. 13, 2016

(86) PCT No.: PCT/US2016/042056
§ 371 (c)(1),
(2) Date: Feb. 28, 2017

(87) PCT Pub. No.: WO2018/013105
PCT Pub. Date: Jan. 18, 2018

(65) Prior Publication Data
US 2018/0228252 A1 Aug. 16, 2018

(51) Int. Cl.
*A44B 11/25* (2006.01)
*A44B 11/00* (2006.01)

(52) U.S. Cl.
CPC ..... *A44B 11/2519* (2013.01); *A44B 11/00* (2013.01); *A44B 11/25* (2013.01); *A44B 11/2573* (2013.01)

(58) Field of Classification Search
CPC ..... A44B 11/2519; A44B 11/00; A44B 11/25; A44B 11/2573
See application file for complete search history.

(56) References Cited

U.S. PATENT DOCUMENTS 7,174,609 B2 * 2/2007 Park ..... A44B 11/266 24/614
2014/0298630 A1 * 10/2014 Hortnagl ..... A44B 11/2592 24/697.2

* cited by examiner

*Primary Examiner* — Abigail E Troy
(74) *Attorney, Agent, or Firm* — Tsz Lung Yeung

(57) ABSTRACT

A buckle assembly includes a first buckle member having an insertion member, a second buckle member, a first buckle latch, a second buckle latch, a plurality of resilient elements, and a locking arrangement. The locking arrangement includes at least two locking protrusions and at least one guiding member. The locking protrusions are extended from one of the insertion member and the second buckle body, and are arranged to form a locking channel between the two locking protrusions. The guiding member is extended from the remaining one of the insertion member and the second buckle body, and is arranged to be inserted in the locking channel formed by the locking protrusions so as to retain the first buckle member to be locked with the second buckle member when the first buckle latch and the second buckle latch are in the locked position.

13 Claims, 5 Drawing Sheets

BUCKLE ASSEMBLY

BACKGROUND OF THE PRESENT INVENTION

Field of Invention

The present invention relates to a buckle, and more particularly to a buckle assembly which comprises a locking arrangement which is capable of providing an enhanced locking performance and convenient operation of the buckle assembly.

Description of Related Arts

A conventional buckle assembly, such as a buckle assembly for use with a webbing strap, usually comprises a first buckle member and a second buckle member detachably engaged with the first buckle member. The first buckle member may have an insertion member while the second buckle member may comprise a plurality of buckle latches and have a receiving slot formed at a position corresponding to the insertion member of the first buckle member. The receiving slot is shaped and sized to receive the insertion member so as to connect the first buckle member to the second buckle member. The buckle latches may be pivotally movable on the second buckle member to selectively lock up the insertion member in the receiving slot. Typically, the first buckle member and the second buckle member are adjustably connected to two end portions of a webbing strap so that the buckle assembly may be utilized for fastening the webbing strap onto a human body or to an external object.

There are several disadvantages in relation to the above-mentioned buckle assembly. First, the first buckle member and the second buckle member are usually locked by the buckle latches, and this locking mechanism is far from reliable. One reason is that the buckle latches may be actuated by accident. Second, even if the first buckle member and the second buckle member are engaged with each other in a proper manner, and the buckle latches are in their proper positions, the engagement between the first buckle member and the second buckle member may be not secure enough and there may exist a lot of relative movements between the first buckle member and the second buckle member. Specifically, when the buckle assembly is being used in various activities, it may subject to a lot of impacts, movements, and vibrations. The result may be that the first buckle member and the second buckle member may move relative to each other. When this relative movement becomes too large, the engagement between the insertion member and the buckle latches may become loose and the engagement between the first buckle member and the second buckle member may become substantially weaker. In worse scenario, the first buckle member and the second buckle member may detach from each other.

As a result, there is a need to develop a buckle assembly which is secured enough when the first buckle member is engaged with the second buckle member.

SUMMARY OF THE PRESENT INVENTION

Certain variations of the present invention provide a buckle assembly which is capable of providing an enhanced locking performance and convenient operation.

Certain variations of the present invention provide a buckle assembly comprising a locking arrangement which is capable of minimizing lateral movements between a first buckle member and a second buckle member when they are engaged with each other.

Certain variations of the present invention provide a buckle assembly, comprising:

a first buckle member which comprises a first buckle body comprising an insertion member;

a second buckle member, which comprises:

a second buckle body which comprises a rear connecting piece, and a front connecting piece attached on the rear connecting piece to define a receiving slot between the rear connecting piece and the front connecting piece, the receiving slot being bounded by at least a rear surface of the front connecting piece and a front guiding surface of the rear connecting piece, and being formed at a position corresponding to the inserting member of the first buckle body;

a first buckle latch and a second buckle latch connected to the second buckle body, each of the first buckle latch and the second buckle latch being arranged to move between a locked position and an unlocked position, wherein in the unlocked position, each of the first buckle latch and the second buckle latch is pivotally moved to allow the insertion member of the first buckle body to be inserted in the receiving slot, wherein in the locked position, each of the first buckle latch and the second buckle latch is pivotally moved to lock up the insertion member of the first buckle body in the receiving slot; and a plurality of resilient elements mounted in the second buckle body to normally exert an urging force to normally retain the first buckle latch and the second buckle latch in the locked position respectively; and a locking arrangement, which comprises:

at least two locking protrusions extended from one of the insertion member and the second buckle body, the locking protrusions being arranged to form a locking channel between the two locking protrusions; and at least one guiding member extended from remaining one of the insertion member and the second buckle body, the guiding member arranged to be inserted in the locking channel formed by the locking protrusions so as to retain the first buckle member to be locked with the second buckle member when the first buckle latch and the second buckle latch are in the locked position.

DETAILED DESCRIPTION OF THE PREFERRED EMBODIMENT

Figure 1:
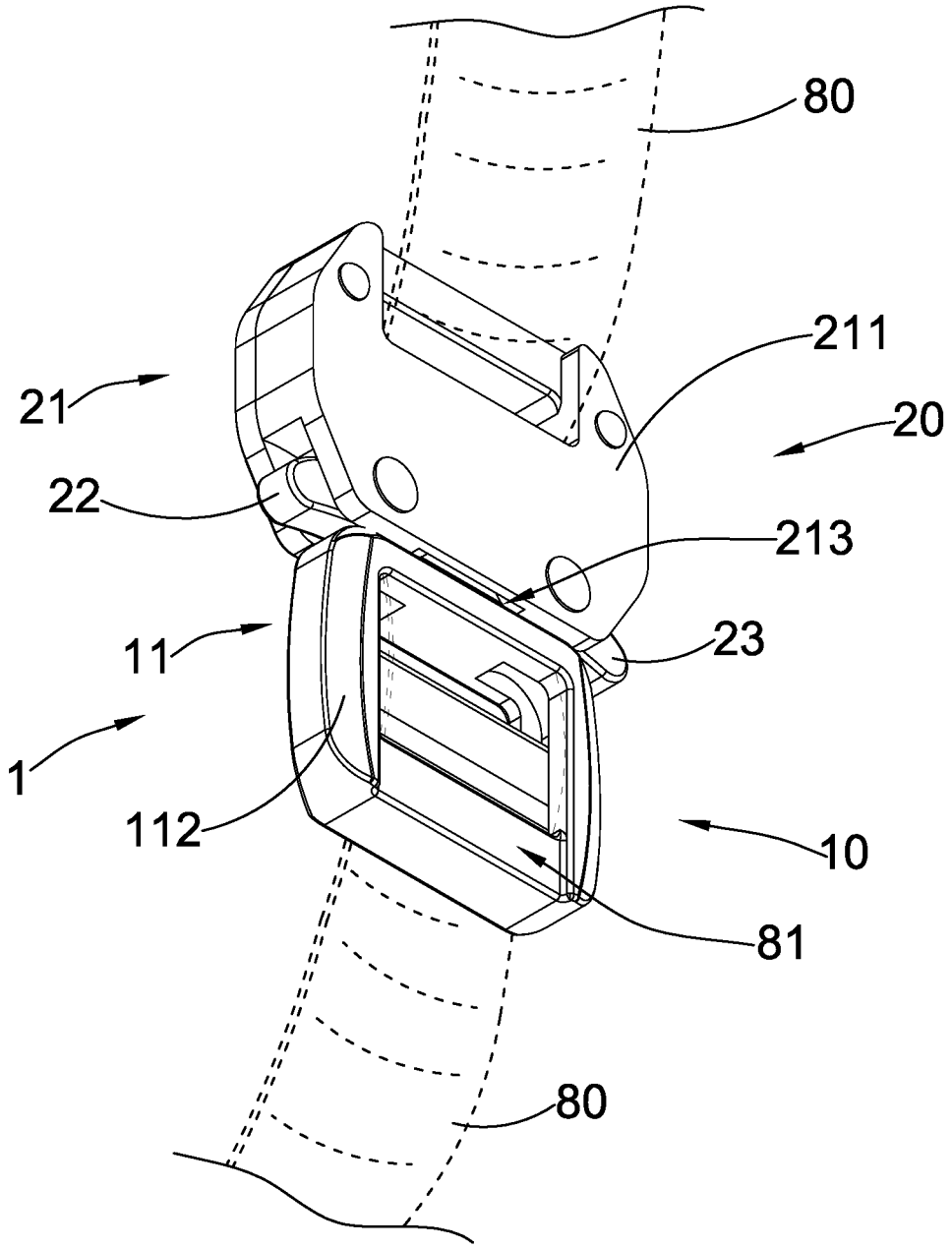
FIG. 1 is a perspective view of a buckle assembly according to a preferred embodiment of the present invention.
Figure 2:
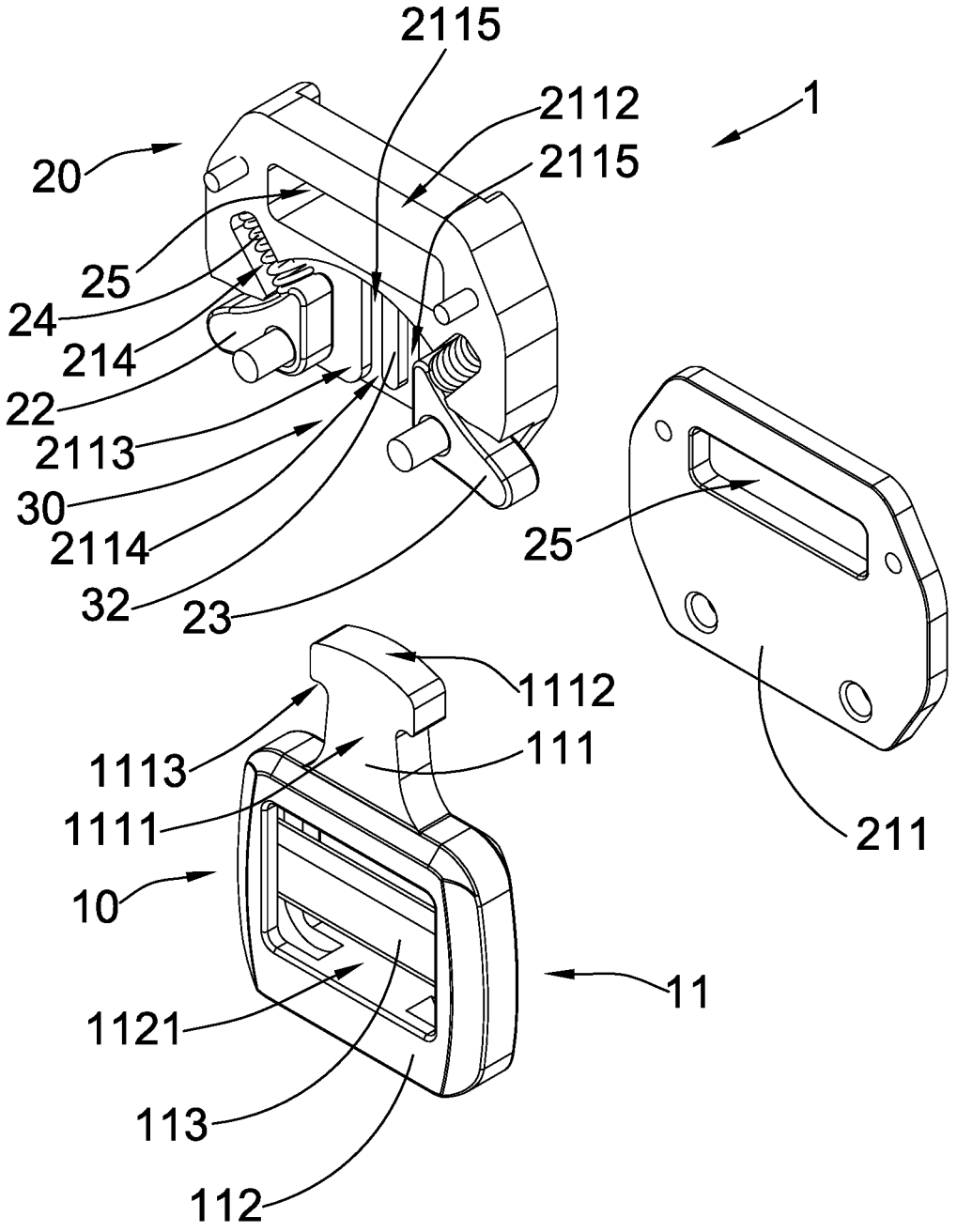
FIG. 2 is an exploded perspective view of the buckle assembly according to the preferred embodiment of the present invention, illustrating a front view of the buckle assembly.
Figure 3:
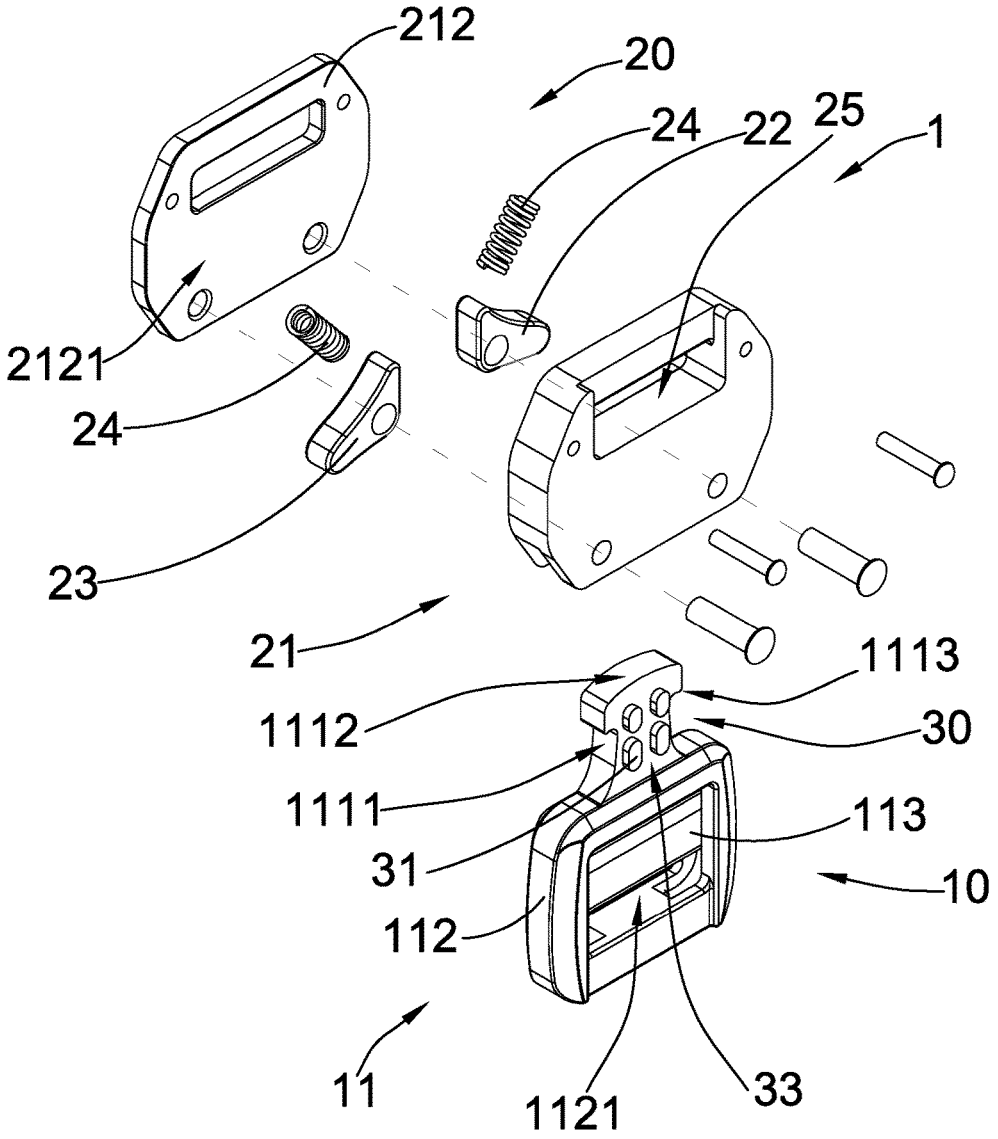
FIG. 3 is an exploded perspective view of the buckle assembly according to the preferred embodiment of the present invention, illustrating a rear view of the buckle assembly.
Figure 4:
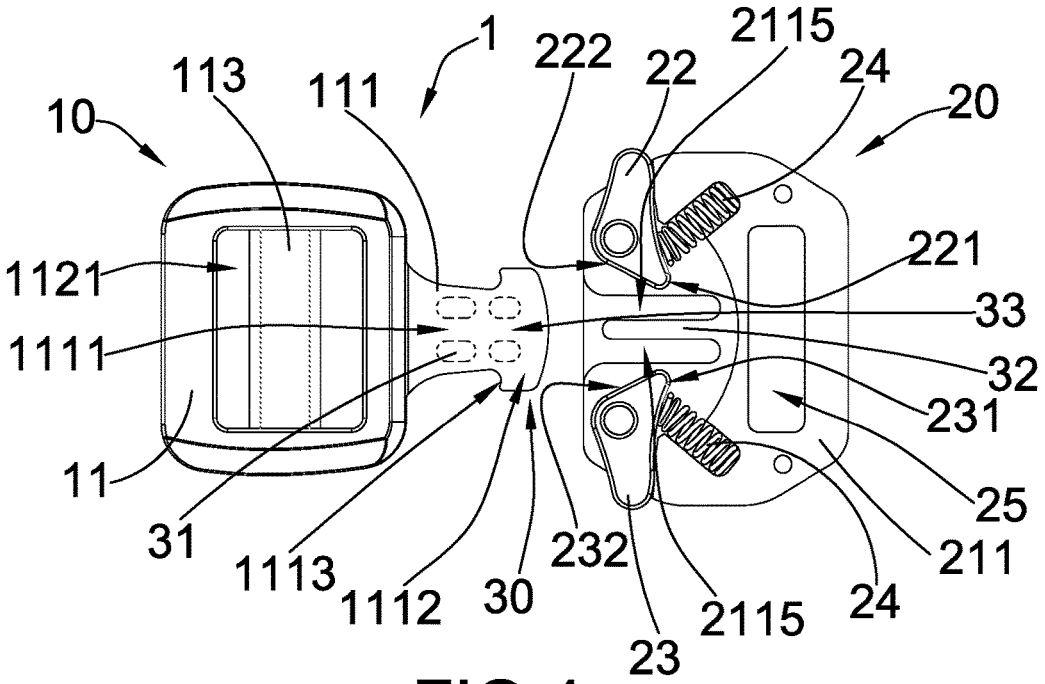
FIG. 4 is a top view of the buckle assembly according to the preferred embodiment of the present invention, illustrating that the first buckle member is detached from the second buckle member.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 7 of the drawings, a buckle assembly 1 according to a preferred embodiment of the present invention is illustrated. Broadly, the buckle assembly 1 comprises a first buckle member 10, a second buckle member 20, and a locking arrangement 30.

The first buckle member 10 may comprise a first buckle body 11 comprising an insertion member 111. The second buckle member 20 may comprise a second buckle body 21, a first buckle latch 22, a second buckle latch 23, and a plurality of resilient elements 24.

The second buckle body 21 may comprise a rear connecting piece 211, and a front connecting piece 212 attached on the rear connecting piece 211 to define a receiving slot 213 between the rear connecting piece 211 and the front connecting piece 212. The receiving slot 213 may be bounded by at least a rear surface 2121 of the front connecting piece 212 and a front guiding surface 2111 of the rear connecting piece 211, and may be formed at a position corresponding to the inserting member 111 of the first buckle body 11.

Figure 5:
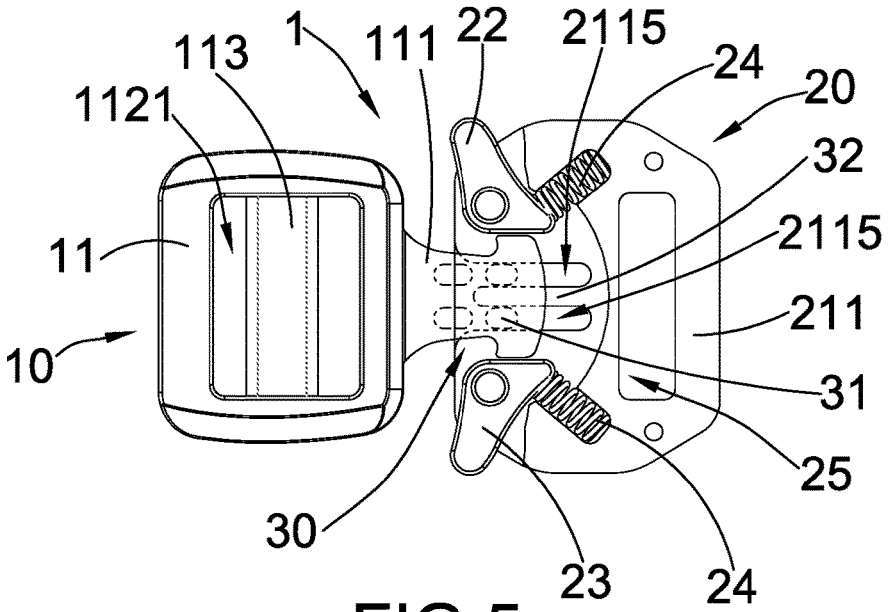
FIG. 5 is a top view of the buckle assembly according to the preferred embodiment of the present invention, illustrating that the first buckle member is partially attached to the second buckle member.
Figure 6:
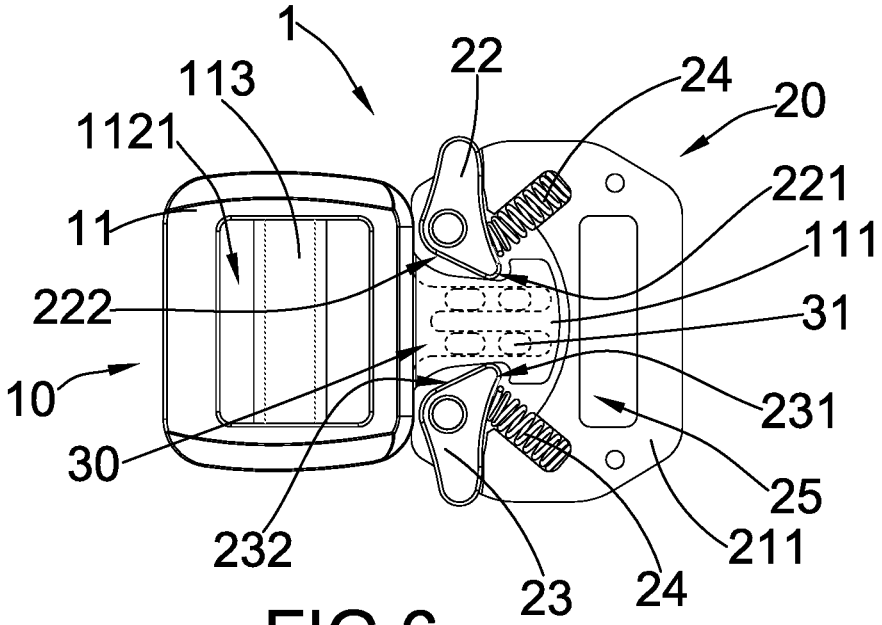
FIG. 6 is a top view of the buckle assembly according to the preferred embodiment of the present invention, illustrating that the first buckle member is completely attached to the second buckle member.

The first buckle latch 22 and a second buckle latch 23 may be connected to the second buckle body 21, wherein each of the first buckle latch 22 and the second buckle latch 23 may be arranged to move between a locked position and an unlocked position. In the unlocked position, each of the first buckle latch 22 and the second buckle latch 23 may be pivotally moved to allow the insertion member 111 of the first buckle body 11 to be inserted in or detached from the receiving slot 213, as shown in FIG. 5 of the drawings. In the locked position, each of the first buckle latch 22 and the second buckle latch 23 may be pivotally moved to lock up the insertion member 111 of the first buckle body 11 in the receiving slot 213, as shown in FIG. 6 of the drawings.

The resilient elements 24 may be mounted in the second buckle body 21 and received in two storage slots 214 respectively to normally exert an urging force to normally retain the first buckle latch 22 and the second buckle latch 23 in the locked position respectively.

The locking arrangement 30 may comprise at least two locking protrusions 31 and at least one guiding member 32. The two locking protrusions 31 may extend from one of the insertion member 111 and the second buckle body 21, and may be arranged to form a locking channel 33 between the two locking protrusions 31.

The guiding member 32 may extend from the second buckle body 21, and may be arranged to be inserted in the locking channel 33 formed by the locking protrusions 31 so as to retain the first buckle member 10 to be locked with the second buckle member 20 when the first buckle latch 22 and the second buckle latch 23 are in the locked position.

According to the preferred embodiment of the present invention, the buckle assembly 1 may be used in conjunction with a webbing strap 80 so that the webbing strap 80 may be worn by a person who may need to bear extensive loading. Alternatively, the webbing strap 80 may also be fastened to an external object. The buckle assembly 1 may also be used in conjunction with other belts, straps etc.

The first buckle body 11 of the first buckle member 10 may further comprise a connecting member 112 for connecting with a first end portion 81 of the webbing strap 80. The connecting member 112 may have a first connecting slot 1121 formed therein. The first buckle body 11 may further comprise a connecting shaft 113 extended across the first connecting slot 1121, so that the first end portion 81 of the webbing strap 80 may be adjustably fastened to the first buckle body 11 by repetitively passing through the first connecting slot 1121 and fastening on the connecting shaft 113.

The insertion member 111 may integrally extend from the first connecting member 112 for selectively receiving in the receiving slot 213. The insertion member 111 may have a contracting portion 1111 and an engaging portion 1112 extended from the contracting portion 1111 to form two engagement shoulders 1113 at an intersection between the contracting portion 1111 and the engaging portion 1112. As shown in FIG. 3 to FIG. 6 of the drawings, the contracting portion 1111 may have a substantially tapered cross section so that a width of the contracting portion 1111 may gradually decrease from the connecting member 112 toward the engaging portion 1112. On the other hand, the engaging portion 1112 may have a transverse width which is greater than that of the contracting portion 1111. The engaging portion 1112 may integrally extend from the contracting portion 1111.

The second buckle member 20 may further have a through second connecting slot 25 formed on the second buckle body 21, wherein a second end portion 82 of the webbing strap 80 may be arranged to pass through the second connecting slot 25 so as to be adjustably fastened on the second buckle body 21.

The resilient elements 24 of the second buckle member 20 may be arranged to bias against one end (unexposed end) of the first buckle latch 22 and the second buckle latch 23 respectively for normally retaining the first buckle latch 22 and the second buckle latch 23 at the locked position.

Referring to FIG. 5 of the drawings, the first buckle latch 22 may have a substantially triangular cross section and forming a first biasing corner portion 221 and a first slanted surface 222 extended from the first biasing corner portion 221. On the other hand, the second buckle latch 23 may also have a substantially triangular cross section and forming a second biasing corner portion 231 and a second slanted surface 232 extended from the second biasing corner portion 231. When the first buckle latch 22 and the second buckle latch 23 are in the locked position, the first and the second slanted surfaces 222, 232 are arranged to face toward the opening of the receiving slot 213 and also each other. The first and the second biasing corner portion 221, 231 may be arranged to engage with the engaging shoulders 1113 of the insertion member 111.

Figure 7:
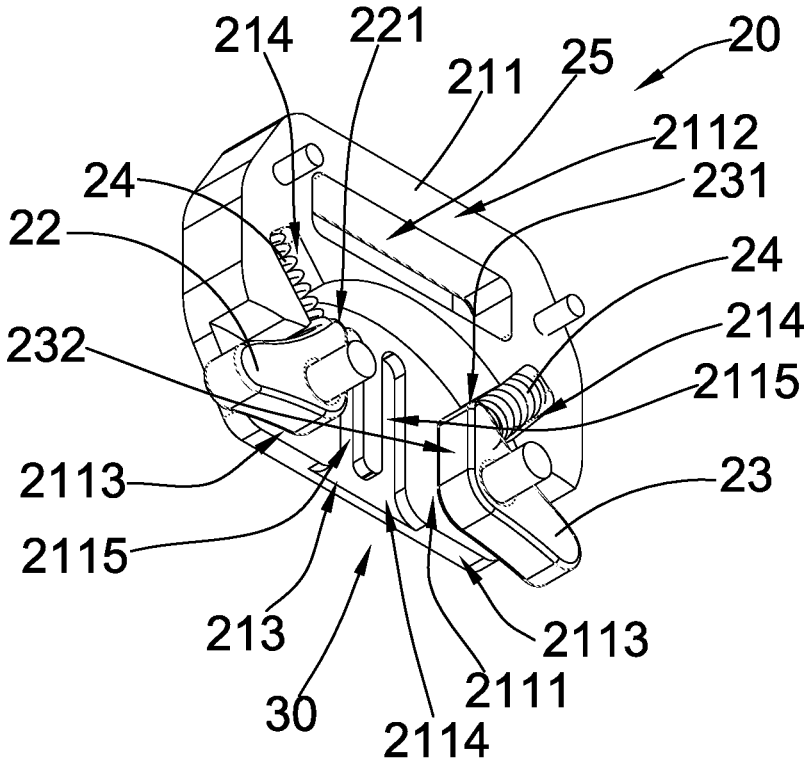
FIG. 7 is a perspective view of the second buckle member of the buckle assembly according to the preferred embodiment of the present invention.

The rear connecting piece 211 of the second buckle body 21 may have a main portion 2112, an attachment portion 2113, and a securing portion 2114. The second connecting slot 25 may be formed on the main portion 2112 of the second buckle body 21. The first buckle latch 22 and the second buckle latch 23 may be formed on the attachment portion 2113 of the rear connecting piece 211. The securing portion 2114 may accommodate the guiding member 32 of the locking arrangement 30. Each of the main portion 2112, the attachment portion 2113 and the securing portion 2114 may have a predetermined thickness. For example, the main portion 2112 may have the greatest thickness while the securing portion 2114 may have the least thickness. The attachment portion 2113 may have a thickness in between of that of the main portion 2112 and the securing portion 2114. This arrangement is shown in FIG. 7 of the drawings.

The locking arrangement 30 may comprise four locking protrusions 31 upwardly protruded from the insertion member 111 of the first buckle member 10. The four locking protrusions 31 may be arranged in an array or a matrix having two rows and two columns. The locking channel 33 may be formed as a space between two columns of the locking protrusions 31. A width of the locking channel 33 may corresponding to or slightly larger than a width of the guiding member 32 so that the guiding member 32 may selectively slide into the locking channel 33. Each of the locking protrusions 31 may have a curved cross sectional shape. Note that other cross sectional shapes are also possible, such as rectangular cross sectional shape, square cross sectional shape, circular cross sectional shape, etc. It is important to mention that the number of locking protrusions 31 may be varied according to the manufacturing and operation circumstances of the present invention. The number of the locking protrusions 31 should not be considered to be limiting.

Referring to FIG. 2, FIG. 4, FIG. 5 and FIG. 7 of the drawings, the guiding member 32 may have an elongated structure and may be extended on the securing portion 2114 of the second buckle body 21. The guiding member 32 may be extended on the securing portion 2114 so as to form two guiding channels 2115 on the securing portion 2114 at two sides of the guiding member 32. When the first buckle body 11 and the second buckle body 21 are engaged with each other, the guiding member 32 may be arranged to slide into the locking channel 33 in such a manner that the locking protrusions 31 which form the locking channel may substantially restrict a movement of the guiding member 32 along a transverse direction thereof. At the same time, each column of the locking protrusions 31 may be guided to slide in the corresponding guiding channel 2115.

The operation of the present invention may be described as follows: the first buckle member 10 and the second buckle member 20 are normally separated from each other. The insertion member 111 of the first buckle body 11 may be inserted into the receiving slot 213 of the second buckle body 21. When the insertion member 111 is inserted into the receiving slot 211, the engaging portion 1112 of the insertion member 111 may be arranged to bias against the first slanted surfaces 222 and the second slanted surface 232 so as to pivotally move the first buckle latch 22 and the second buckle latch 23 until the they engage with the engagement shoulder 1113 of the insertion member 111. At that time, the first buckle latch 22 and the second buckle latch 23 are urged by the resilient elements 24 to move back to the locked position.

When the insertion member 111 is being inserted in the receiving slot 213, the guiding member 32 may be arranged to slide into the locking channel 33. The locking protrusions 31 may restrict transverse movement (i.e. movement in the transverse direction of the first or the second buckle member) of the second buckle member 20. In other words, lateral movement, especially in the transverse direction, between the first buckle member 10 and the second buckle member 20 may be minimized.

The present invention, while illustrated and described in terms of a preferred embodiment and several alternatives, is not limited to the particular description contained in this specification. Additional alternative or equivalent components could also be used to practice the present invention.

What is claimed is:

1. A buckle assembly, comprising:

a first buckle member which comprises a first buckle body comprising an insertion member;

a second buckle member, which comprises:

a second buckle body which comprises a rear connecting piece, and a front connecting piece attached on said rear connecting piece to define a receiving slot between said rear connecting piece and said front connecting piece, said receiving slot being bounded by at least a rear surface of said front connecting piece and a front guiding surface of said rear connecting piece, and being formed at a position corresponding to said insertion member of said first buckle body;

a first buckle latch and a second buckle latch connected to said second buckle body, each of said first buckle latch and said second buckle latch being arranged to move between a locked position and an unlocked position, wherein in said unlocked position, each of said first buckle latch and said second buckle latch is pivotally moved to allow said insertion member of said first buckle body to be inserted in said receiving slot, wherein in said locked position, each of said first buckle latch and said second buckle latch is pivotally moved to lock up said insertion member of said first buckle body in said receiving slot; and a plurality of resilient elements mounted in said second buckle body to exert an urging force to retain said first buckle latch and said second buckle latch in said locked position respectively; and a locking arrangement, which comprises:

four locking protrusions extended from said insertion member, said locking protrusions being arranged to form a locking channel between said four locking protrusions, said four locking protrusions being arranged in an array having two rows and two columns, said locking channel being formed as a space between said two columns of said locking protrusions; and at least one guiding member extended from said second buckle body, said at least one guiding member arranged to be inserted in said locking channel formed by said locking protrusions so as to retain said first buckle member to be locked with said second buckle member when said first buckle latch and said second buckle latch are in said locked position;

said rear connecting piece of said second buckle body having a main portion, an attachment portion, and a securing portion, a second connecting slot being formed on said main portion, said first buckle latch and said second buckle latch being supported on said attachment portion, said at least one guiding member being extended on said securing portion to form two guiding channels at two sides of said guiding member respectively on said securing portion, said locking protrusions being arranged to slide in said guiding channels when said first buckle member is engaged with said second buckle member.

2. The buckle assembly, as recited in claim 1, wherein each of said main portion, said attachment portion and said securing portion has thicknesses such that said main portion has greatest thickness while said securing portion has least thickness, said attachment portion having a thickness which lies between a thickness of said main portion and a thickness of said securing portion.

3. The buckle assembly, as recited in claim 2, wherein a width of said locking channel is slightly larger than a width of said at least one guiding member so that said at least one guiding member is capable of being selectively slid into said locking channel.

4. The buckle assembly, as recited in claim 3, wherein said first buckle body of said first buckle member further comprises a connecting member having a first connecting slot, said first buckle body further comprising a connecting shaft extended across said first connecting slot.

5. The buckle assembly, as recited in claim 4, wherein said insertion member has a contracting portion and an engaging portion extended from said contracting portion to form two engagement shoulders at an intersection between said contracting portion and said engaging portion, said engaging portion having a transverse width which is greater than that of said contracting portion.

6. The buckle assembly, as recited in claim 5, wherein said first buckle latch has a first biasing corner portion and a first slanted surface extended from said first biasing corner portion, said second buckle latch having a second biasing corner portion and a second slanted surface extended from said second biasing corner portion, such that when said first buckle latch and said second buckle latch are in said locked position, said first and said second slanted surfaces are arranged to face toward an opening of said receiving slot and also toward each other, said first and said second biasing corner portion being arranged to engage with said engaging shoulders of said insertion member when said first buckle member is engaged with said second buckle member.

7. The buckle assembly, as recited in claim 4, wherein said first buckle latch has a first biasing corner portion and a first slanted surface extended from said first biasing corner portion, said second buckle latch having a second biasing corner portion and a second slanted surface extended from said second biasing corner portion, such that when said first buckle latch and said second buckle latch are in said locked position, said first and said second slanted surfaces are arranged to face toward an opening of said receiving slot and also toward each other, said first and said second biasing corner portion being arranged to engage with engaging shoulders of said insertion member when said first buckle member is engaged with said second buckle member.

8. The buckle assembly, as recited in claim 3, wherein said insertion member has a contracting portion and an engaging portion extended from said contracting portion to form two engagement shoulders at an intersection between said contracting portion and said engaging portion, said engaging portion having a transverse width which is greater than that of said contracting portion.

9. The buckle assembly, as recited in claim 2, wherein said first buckle body of said first buckle member further comprises a connecting member having a first connecting slot, said first buckle body further comprising a connecting shaft extended across said first connecting slot.

10. The buckle assembly, as recited in claim 1, wherein a width of said locking channel is slightly larger than a width of said at least one guiding member so that said at least one guiding member is capable of being selectively slid into said locking channel.

11. The buckle assembly, as recited in claim 1, wherein said first buckle body of said first buckle member further comprises a connecting member having a first connecting slot, said first buckle body further comprising a connecting shaft extended across said first connecting slot.

12. The buckle assembly, as recited in claim 1, wherein said insertion member has a contracting portion and an engaging portion extended from said contracting portion to form two engagement shoulders at an intersection between said contracting portion and said engaging portion, said engaging portion having a transverse width which is greater than that of said contracting portion.

13. The buckle assembly, as recited in claim 1, wherein said first buckle latch has a first biasing corner portion and a first slanted surface extended from said first biasing corner portion, said second buckle latch having a second biasing corner portion and a second slanted surface extended from said second biasing corner portion, such that when said first buckle latch and said second buckle latch are in said locked position, said first and said second slanted surfaces are arranged to face toward an opening of said receiving slot and also toward each other, said first and said second biasing corner portion being arranged to engage with engaging shoulders of said insertion member when said first buckle member is engaged with said second buckle member.

* * * * *